US011542051B2

(12) United States Patent
Dittrich et al.

(10) Patent No.: US 11,542,051 B2
(45) Date of Patent: Jan. 3, 2023

(54) SYSTEMS AND METHODS FOR STACKING PRODUCT

(71) Applicant: House of Design LLC, Nampa, ID (US)

(72) Inventors: Shane Christopher Dittrich, Nampa, ID (US); Kristopher Ryan Okelberry, Nampa, ID (US)

(73) Assignee: House of Design LLC, Nampa, ID (US)

( * ) Notice: Subject to any disclaimer, the term of this patent is extended or adjusted under 35 U.S.C. 154(b) by 62 days.

(21) Appl. No.: 17/099,459

(22) Filed: Nov. 16, 2020

(65) Prior Publication Data

US 2021/0147102 A1 May 20, 2021

Related U.S. Application Data

(60) Provisional application No. 62/935,911, filed on Nov. 15, 2019.

(51) Int. Cl.

| | |
|---|---|
| ***B65B 35/50*** | (2006.01) |
| ***B65B 11/04*** | (2006.01) |
| ***B65B 57/14*** | (2006.01) |
| ***B65B 35/18*** | (2006.01) |
| ***B65B 35/16*** | (2006.01) |

(52) U.S. Cl.

CPC ..... *B65B 35/50* (2013.01); *B65B 11/045* (2013.01); *B65B 35/16* (2013.01); *B65B 35/18* (2013.01); *B65B 57/14* (2013.01); *B65B 2210/14* (2013.01)

(58) Field of Classification Search

CPC ..... B65B 11/045; B65B 35/16; B65B 35/18; B65B 35/50; B65B 57/14; B65B 2210/14; B65G 61/00

See application file for complete search history.

(56) References Cited

U.S. PATENT DOCUMENTS 4,546,593 A * 10/1985 Lasscock ..... B65B 35/50 414/788.9
5,005,335 A * 4/1991 Yourgalite et al. ... B65B 11/045 53/399
5,430,995 A * 7/1995 Cere ..... B65B 11/045 53/375.9
5,566,530 A * 10/1996 Johnstone et al. .... B65B 11/045 53/575

(Continued)

FOREIGN PATENT DOCUMENTS

CN 208100368 U * 11/2018
CN 208409917 U * 1/2019

(Continued)

*Primary Examiner* — Stephen F. Gerrity
(74) *Attorney, Agent, or Firm* — Foley & Lardner LLP

(57) ABSTRACT

A product stacking system may include an open bag detection subsystem and a product stacking subsystem. The open bag detection subsystem may agitate bags to cause product to be displaced out of open bags and determine if a bag is open by comparing a weight of the bag after the agitation to a target threshold. The product stacking subsystem may include a robotic arm and a controller that moves the robotic arm between posts of a bin based on an orientation of the bin. A turntable rotates the bin and can operate as an additional axis of movement of the robot.

19 Claims, 8 Drawing Sheets

(56) References Cited

U.S. PATENT DOCUMENTS

| | | | | |
|---|---|---|---|---|
| 6,558,108 | B1 * | 5/2003 | Van Oord | B65B 61/207 414/789.5 |
| 8,074,431 | B1 * | 12/2011 | Pierson et al. | B65B 11/045 53/529 |
| 10,287,112 | B2 * | 5/2019 | Saylor | B65B 11/045 |
| 2008/0318750 | A1 * | 12/2008 | Combrink | B65B 57/14 493/182 |
| 2011/0233090 | A1 * | 9/2011 | Briggs et al. | B65B 11/045 206/391 |
| 2019/0322451 | A1 * | 10/2019 | Bastian, II et al. | B65B 35/16 |
| 2019/0382220 | A1 * | 12/2019 | Boudreau | B65B 11/045 |

FOREIGN PATENT DOCUMENTS

| | | | | |
|---|---|---|---|---|
| CN | 209023817 | U * | 6/2019 | |
| WO | WO-2014075151 | A1 * | 5/2014 | B65B 35/50 |

* cited by examiner

SYSTEMS AND METHODS FOR STACKING PRODUCT

CROSS-REFERENCES TO RELATED APPLICATIONS

This application claims benefit of priority under 35 U.S.C. § 119 to U.S. Provisional Patent Application No. 62/935,911 titled SYSTEMS AND METHODS FOR STACKING PRODUCT and filed Nov. 15, 2019, which is hereby incorporated herein by reference in its entirety.

TECHNICAL FIELD

The present disclosure relates generally to the field of product packaging, and more particularly to systems and methods for stacking bags of product into containers for shipment.

BRIEF DESCRIPTION OF THE SEVERAL VIEWS OF THE DRAWINGS

Additional aspects and advantages will be apparent from the following detailed description of preferred embodiments, which proceeds with reference to the accompanying drawings, in which.

Figure 1:
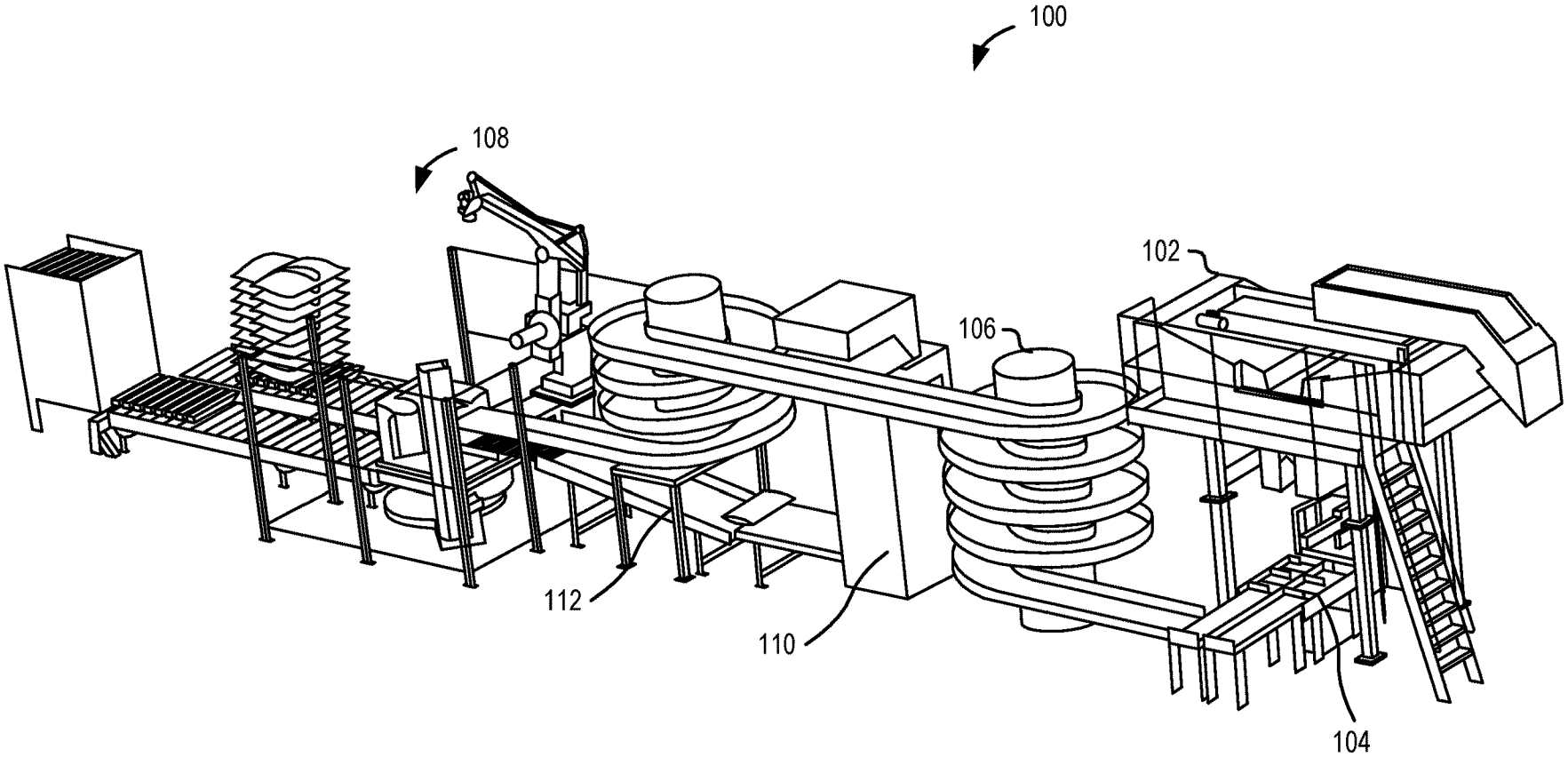
FIG. 1 is a perspective view of a product packaging system in accordance with one embodiment of the present disclosure.

To easily identify the discussion of any particular element or act, the most significant digit or digits in a reference number refer to the figure number in which that element is first introduced.

DETAILED DESCRIPTION

Automating product packaging provides significant labor and economic benefits as it increases the efficiency of a system. Often products are not sold individually. Rather, products are placed in a bag to be sold. If a bag is not sealed correctly, product may fall out of the bag before reaching a destination, thereby wasting the product. The embodiments disclosed herein are described with reference to a bag. As can be appreciated, the disclosed embodiments may operate with other types of packages as well, and the term bag in the present disclosure is representative of any suitable or appropriate type of packaging.

Additionally, bags are often stacked onto pallets or into bins for shipping. These bins may have posts extending above the openings. The posts may be used to add additional height to the bin by wrapping material around the outside of the posts. Stacking into these bins is often done manually. To increase efficiency, a robotic arm may be used to stack the bags in the bins. However, a robotic arm that is tall enough to reach over the posts of the bin and place a bag at the bottom of the bin would likely be prohibitively expensive.

Described herein are embodiments of a packaging system that confirms a bag or other package is closed and sealed, before directing the bag or package to a stacking area. Described herein are embodiments of a packaging system that includes a robotic arm to stack bags or other packages in a bin or on a pallet. Described herein are embodiments of a packaging system that confirms bags are closed and sealed before a robotic arm stacks the bags in a bin or onto a pallet. Additionally, some embodiments herein use a robotic arm that maneuvers between posts to stack products in a bin to use a smaller robotic arm than would be needed to reach over the posts of the bin and place a bag at the bottom of the bin. A wrap dispenser may dispense and/or apply a wrap around the posts to raise a height of the bin as product is stacked therein or to otherwise allow product to be stacked above an initial height of the bin and/or between the posts.

For example, a packaging system as described herein may bag produce (e.g., potatoes, apples, onions, etc.) and check that the produce is sealed or otherwise secured within the bag. The bag seal check may include moving the bag over an uneven surface to agitate the produce in the bag and cause produce in open bags to fall out. A weight check would reveal that the bag was open and should be rejected from a stacking and/or shipping area. A robotic arm at or near the stacking and/or shipping area may couple to the bags that are determined to be closed and maneuver the bags between posts of a bin and stack the bags inside the bin for shipment. A turntable may rotate the bin and a shrink wrap dispenser may shrink wrap the posts to raise a height of the bin as product is stacked therein.

The phrases "connected to" and "coupled to" are used herein in their ordinary sense, and are broad enough to refer to any suitable coupling or other form of interaction between two or more entities, including mechanical, fluid, and thermal interaction. Two components may be coupled to each other even though they are not in direct contact with each other. The phrase "attached to" refers to interaction between two or more entities which are in direct contact with each other and/or are separated from each other only by a fastener of any suitable variety (e.g., an adhesive, stitching, etc.).

The terms "a" and "an" can be described as one, but not limited to one. For example, although the disclosure may recite an element having, e.g., "a support member," the disclosure also contemplates that the element can have two or more support members.

Reference throughout this specification to "an embodiment" or "the embodiment" means that a particular feature, structure, or characteristic described in connection with that embodiment is included in at least one embodiment. Thus, the quoted phrases, or variations thereof, as recited throughout this specification are not necessarily all referring to the same embodiment. Not every embodiment is shown in the accompanying illustrations, however, at least a preferred embodiment is shown. At least some of the features described for a shown preferred embodiment are present in other embodiments.

In the following detailed description, reference is made to the drawings. In some instances, like reference numerals are used in the various drawings to indicate similar elements. It will be understood that the components of the embodiments as generally described and illustrated in the figures herein could be arranged and designed in a wide variety of different configurations. Thus, the following more detailed description of various embodiments, as represented in the figures, is not intended to limit the scope of the disclosure, as claimed, but is merely representative of various embodiments. While the various aspects of the embodiments are presented in drawings, the drawings are not necessarily drawn to scale unless specifically indicated.

FIG. 1 is a perspective view of a product packaging system 100 in accordance with one embodiment. In the illustrated embodiment, the product packaging system 100 comprises a bagger 102, an open bag detection subsystem 104, a spiral conveyer 106, and a product stacking subsystem 108. The product packaging system 100 may package products and stack the products on pallets or in containers for delivery and/or storage.

The bagger 102 receives product and packages the product into a bag. In some embodiments, the product is placed in a weigh hopper. The weigh hopper weighs the accumulated weight of the product currently in the weigh hopper and compares the accumulated weight against a target weight. If the target weight is not reached, additional product is added to the weigh hopper. If the accumulated weight meets the target weight, then the products are dumped into a bag. In some embodiments, the bag is in the weigh hopper and the product is placed in the bag as it is being weighed. In some embodiments, the bagger 102 may count the product being bagged and use the product count rather than the accumulated weight to fill a bag with a desired amount. Once the bag is filled to the target weight or with the desired number of products, the bagger 102 may seal the bag closed.

The open bag detection subsystem 104 checks that each bag was properly closed and sealed by the bagger 102 and/or that the bag is appropriately containing the product (e.g., that rips, tears, holes are not present). The open bag detection subsystem 104 receives a bag from the bagger 102 and agitates the bag to cause products to be displaced out of the bag if it is open, sealed improperly, torn or punctured, or otherwise not appropriately packaging the product therein. The open bag detection subsystem 104 weighs the bag and compares that weight to a target threshold. If the weight of the bag is at or above the target threshold the bag may be directed to the next part of the product packaging system 100. If the weight of the bag is below the target threshold the bag may be directed to a reject area as being determined to be opened or otherwise a defective package for the product.

After the bags are checked by the open bag detection subsystem 104, the spiral conveyer 106 moves the bags to product stacking subsystem 108. In some embodiments, a non-spiral conveyer may transport the bags to product stacking subsystem 108. In some embodiments, the product stacking subsystem 108 may receive the bags directly from the open bag detection subsystem.

In the illustrated embodiment, the spiral conveyer 106 comprises a baler 110. The product packaging system 100 may selectively use the baler 110 to package multiple bags together. The baler 110 may count the number of bags that enter the baler 110 and pack the bags into a bale once a desired number of bags is accumulated. The bales may comprise large bags to store the accumulated bags. Once the large bags are filled, the baler 110 may close and seal the large bags. The spiral conveyer 106 may selectively provide the product stacking subsystem 108 with a bag of the product or a bale of bags. For example, the spiral conveyer 106 may send bags down the spiral conveyer 106 to the product stacking subsystem 108, or a bottom conveyer 112 may move a bale to the product stacking subsystem 108.

The product stacking subsystem 108 stacks the bags or bales of products. The product stacking subsystem 108 may stack the bags or bales directly on a pallet or in a container. In some embodiments, the product stacking subsystem 108 may determine whether the product is packaged in a bag or a bale and stack based on that determination. For example, the product stacking subsystem 108 may stack bales directly on a pallet and may stack bags into a container. The container may be an object capable of holding the bags during transport. For example, the container may be a bin, basket, box, or crate. In some embodiments, the container is a bin comprising a plurality of posts that may be used to extend the height of the bin. In some embodiments, the product stacking subsystem 108 includes a robotic arm to engage, move, and release product (e.g., a bag, a bale, etc.) to stack the product on a pallet or in a container. In some embodiments the product stacking subsystem 108 may include a turntable to rotate the pallet or container to facilitate positioning of the product for stacking.

Figure 2:
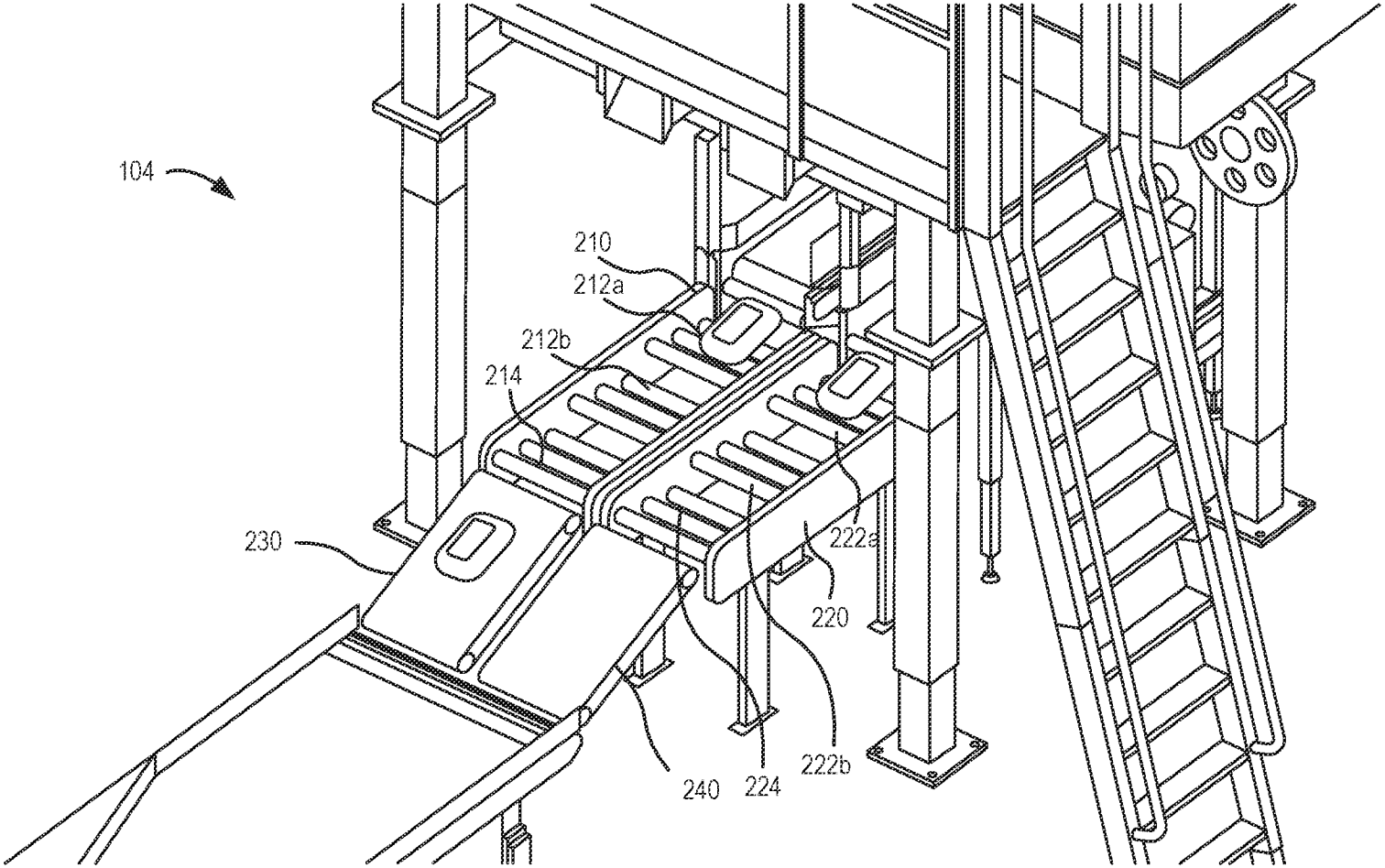
FIG. 2 is a perspective view of the open bag detection subsystem of the product packaging system of FIG. 1.

FIG. 2 is a perspective view of the open bag detection subsystem 104 of the product packaging system of FIG. 1. The open bag detection subsystem 104 may comprise one or more agitation conveyers (e.g., first agitation conveyer 210, and second agitation conveyer 220, herein referred to as agitation conveyers 210, 220), and one or more weigh stations (e.g., first weigh station 214, and second weigh station 224, herein referred to as weigh stations 214, 224), and a controller. While the illustrated embodiment of the open bag detection subsystem 104 includes a pair of agitation conveyers 210, 220 and weigh stations 214, 224, other embodiments may include one agitation conveyer and one weigh station. While in yet other embodiments, the open bag detection subsystem 104 may include more than two agitation conveyers and one weigh station for additional product throughput.

The agitation conveyers 210, 220 are configured to cause products to fall out of open bags. As illustrated in some embodiments, the agitation conveyers 210 and 220 convey the bags across an uneven surface to jostle products in the bag and potentially cause the products to fall out of the bag if the bag is open. The uneven surface of the agitation conveyers 210, 220 may comprise multiple rollers positioned with staggered elevation. For example, in the illustrated embodiment, each of the agitation conveyers 210, 220 includes multiple sets of rollers (e.g., first set of rollers 212*a*, second set of rollers 212*b*, third set of rollers 222*a*, fourth set of rollers 222*b*). The agitation conveyers 210, 220 may also include vertical drops between the sets of rollers. The vertical drops may be sized to be less than a width or length of the bag so that a vertical drop between sets will cause a top portion of the bag to sag or bend downward before the whole bag is supported by the next set of rollers. The unevenness of the rollers along with vertical drops in between the sets of rollers may provide sufficient agitation to cause products to fall out of open bags.

Additionally, in some embodiments, each set of rollers may be sloped upward such that the bag ascends vertically before falling across the vertical drop. For example, the first set of rollers 212*a* may receive a bag at a first height and move the bag across the rollers of the first set of rollers 212*a* to a second height, where the first height is lower than the second height. The bag may then fall to the second set of rollers 212*b*. In some embodiments, the first roller of the second set of rollers 212*b* may be the same height as the first roller (at the first height) of the first set of rollers 212*a*. In some embodiments, the first roller of the second set of rollers 212*b* may be lower than the first roller (at the first height) of the first set of rollers 212*a*.

Movement across the rollers may be facilitated with a motor and/or via gravity. In some embodiments the rollers of the agitation conveyers 210, 220 may be motorized. For example, a motor may cause the rollers to rotate thereby causing the bags to move along the uneven surface. In some embodiments, the rollers and sets of rollers may be arranged in a downward slope to allow gravity to facilitate the movement of the bag across the uneven surface.

The weigh stations weigh the bag after moving along the uneven conveyer. As shown, in some embodiments, the weigh stations 214, 224 are integrated into a final set rollers. In other embodiments, the weigh stations 214, 224 may comprise a platform separate from the rollers. For example, the weigh stations 214, 224 may be integrated into chutes 230, 240.

The controller (also referred to herein as the detection controller) may compare a weight of the bag from the weigh station to a target threshold, and direct the bag to one of a reject area and a shipping area based on the comparison. The shipping area includes downstream equipment to move, bale, and/or stack the bags. For example, if the weight of the bag is less than the target threshold (which may be caused by product falling out of an open bag) the controller may cause the chutes 230, 240 to open and send the bag to a reject area under the chute. In other embodiments, the controller may cause a divider along a channel after the weigh station to change position to send the bag to either the reject area or the shipping area.

Figure 3:
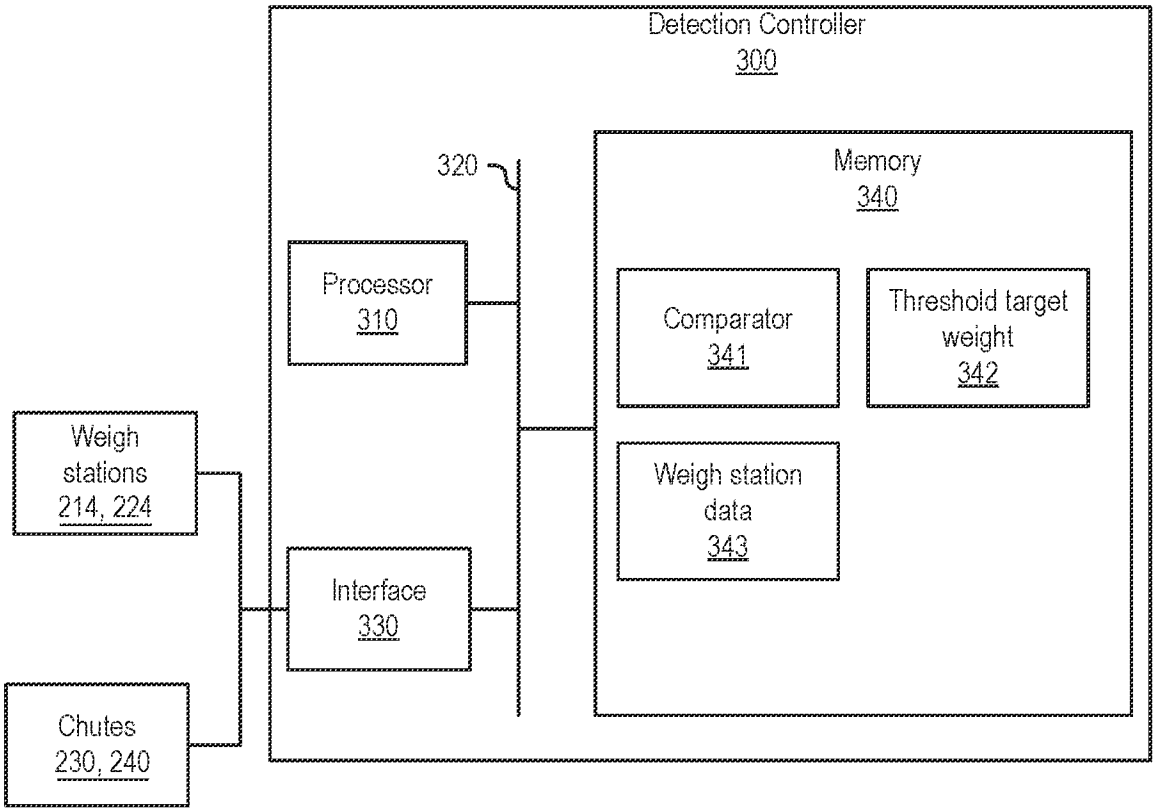
FIG. 3 is a block diagram of a detection controller of the open bag detection subsystem of FIG. 2.

FIG. 3 is a block diagram of a detection controller 300 of the open bag detection subsystem of FIG. 2. The detection controller 300 may comprise a processor 310, a memory 340, and an interface 330. A bus 320 may interconnect various integrated and/or discrete components. The interface 330 may facilitate an interconnection between the detection controller 300 and other devices such as the weigh stations 214,224 and the chutes 230, 240. These components may allow the detection controller 300 to identify open bags and correctly route the open bags and the sealed bags.

The processor 310 may include one or more general purpose devices, such as an Intel®, AMD®, or other standard microprocessor. The processor 310 may include a special purpose processing device, such as ASIC, SoC, SiP, FPGA, PAL, PLA, FPLA, PLD, or other customized or programmable device. The processor 310 may perform distributed (e.g., parallel) processing to execute or otherwise implement functionalities of the presently disclosed embodiments.

The memory 340 may include static RAM, dynamic RAM, flash memory, one or more flip-flops, ROM, CD-ROM, DVD, disk, tape, or magnetic, optical, or other computer storage medium. The memory 340 may store a target threshold weight 342, weigh station data 343, and programs to process the weigh station data 343 (e.g., comparator 341). The memory 340 may be local to the detection controller 300, as shown, or may be distributed and/or remote relative to the detection controller 300.

When the processor 310 executes the comparator 341 program, the detection controller 300 compares a weight of the bag from the weigh station data 343 to the target threshold weight 342. Based on that comparison, the detection controller 300 sends a signal to the chutes 230, 240 to direct the bag to one of a reject area and a shipping area. For example, the detection controller 300 may determine that a bag is open if the weight is less than the target threshold weight 342. If the weight is less than the target threshold weight 342 the detection controller 300 may cause a chute to open to send the open bag to the reject area. The detection controller 300 may determine that a bag is closed if the weight is equal to or more than the target threshold weight 342. If the weight is equal to or more than the target threshold weight 342 the detection controller 300 may cause a chute to direct the bag to downstream equipment.

Figure 4:
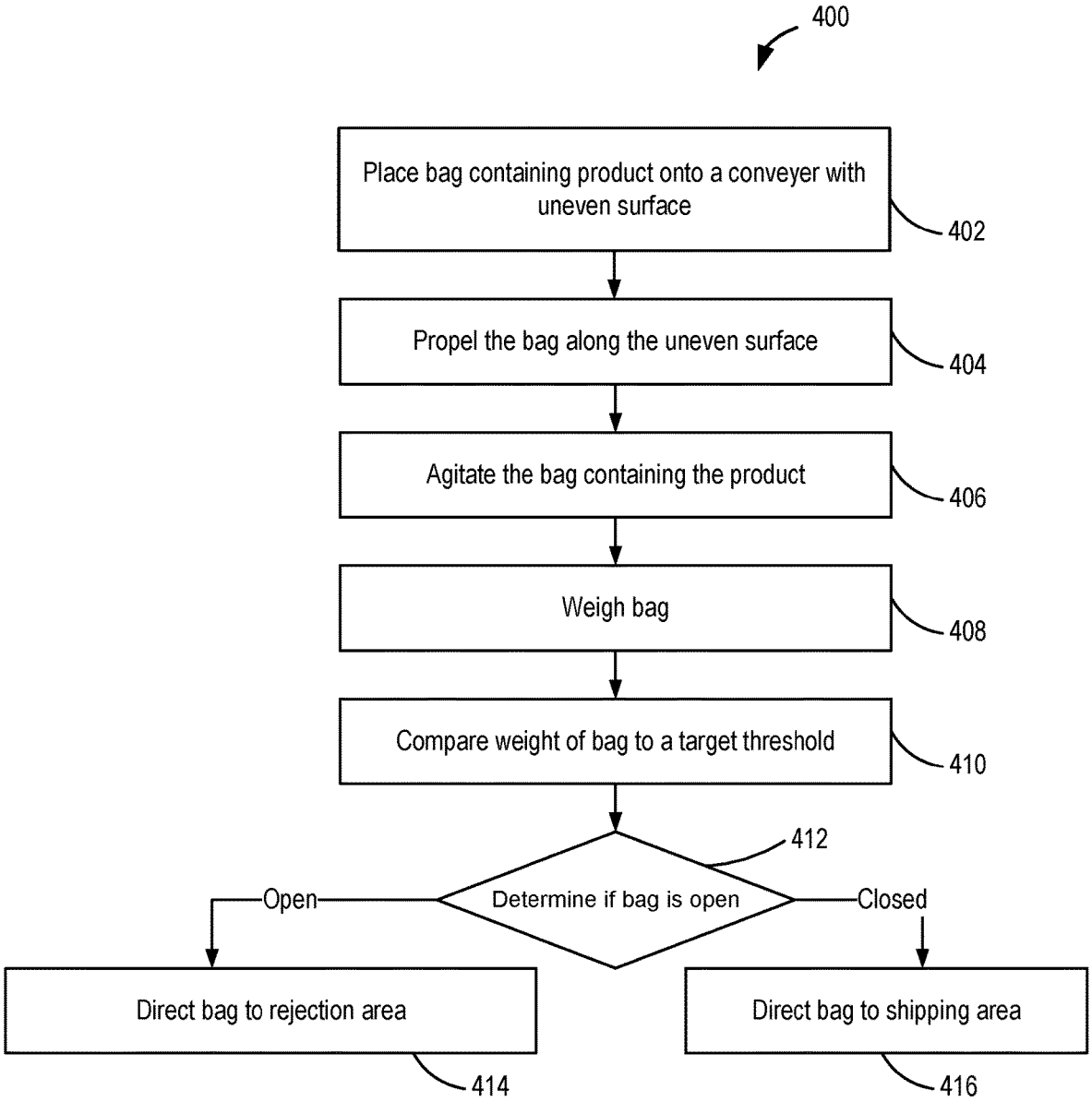
FIG. 4 is a flowchart illustrating a method of operating the open bag detection subsystem of FIG. 2, according to some embodiments.

FIG. 4 is a flowchart illustrating a method 400 of operating the open bag detection subsystem of FIG. 2, according to some embodiments. The method includes placing 402 a bag containing product onto a conveyer with an uneven surface. The conveyer may comprise a series of rollers with staggered elevations. For example, the series of rollers may be divided into cascading sets that cause a bag to drop or bend between sets. The conveyer may propel 404 the bag along the uneven surface to agitate 406 the bag containing the product. The agitation may cause products to fall out of open bags.

A weigh station may weigh 408 the bags after the bags were agitated. The open bag detection subsystem may compare 410 a weight of the bag as measured by the weigh station to a target threshold. In other embodiments, the open bag detection subsystem may compare 410 a weight of the bag to a starting weight of the bag as measured before agitation of the bag. The open bag detection subsystem may determine 412 if the bag is open or closed based on the weight comparison. For example, if the weight of the bag is below the target threshold, the bag is determined to be open. If the weight of the bag is at or above the target threshold the bag is determined to be closed. This is because product from an open bag falls out as the agitation conveyer moves the bag across the uneven surface.

The open bag detection subsystem may direct the bag based on the open or closed determination. For example, if the bag is determined to be open, the open bag detection subsystem directs 414 the bag to a rejection area. If the bag is determined to be closed, the open bag detection subsystem directs 416 the bag to downstream equipment toward the shipping area. The directing may be accomplished in a variety of ways. For instance, the open bag detection subsystem may open a chute or a door, or change the position of a switch, lever, or blade.

Figure 5:
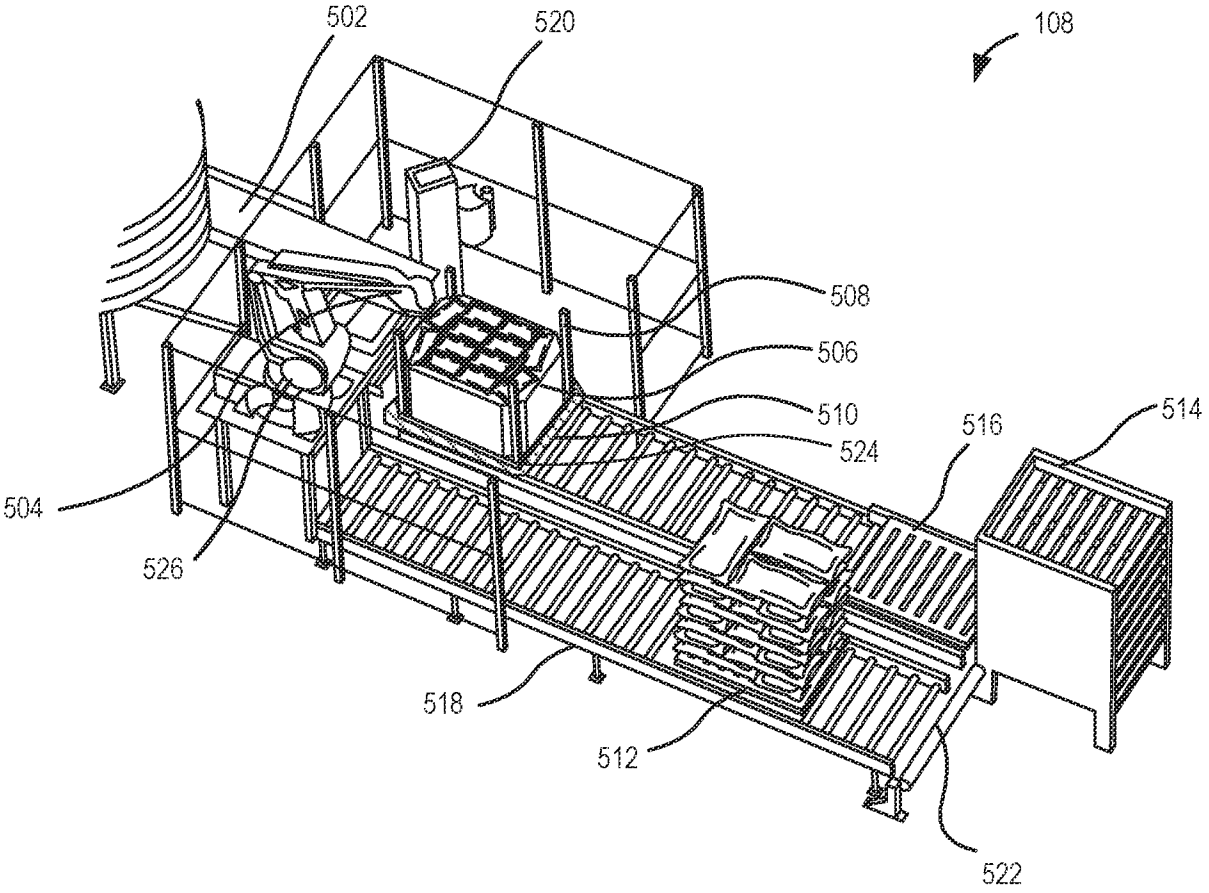
FIG. 5 is a perspective view of the product stacking subsystem of the product packaging system of FIG. 1.

FIG. 5 is a perspective view of the product stacking subsystem 108 of the product packaging system of FIG. 1. The product stacking subsystem 108 may comprise a robotic arm 504 to stack bags or bales of products for delivery. Additionally, in some embodiments, the product stacking subsystem 108 may comprise a turntable 510, a wrap (e.g., a shrink wrap) dispenser 520, and a pallet feeder 514.

The robotic arm 504 may be an appropriate robotic mechanism to access a product provided to the product stacking subsystem 108, engage the product, move the product, and place the product onto a stack (e.g., on a pallet or in a container), and release the product. In some embodiments, the robotic arm 504 may comprise a 6-axis robotic arm, which can position an object in three axes 526 of space (Cartesian coordinates x, y, z) and orient the object in three axes 526 of orientation (yaw, pitch and roll). As can be appreciated, a robotic arm 504 may comprise fewer axes 526 of movement.

In some embodiments, the robotic arm 504 may include the turntable 510, which thereby provides the robotic arm 504 an additional axis of movement. Stated differently, the turntable 510 may be a part of or otherwise controlled by a controller of the robotic arm 504, such that the robotic arm 504 includes an additional axis of movement 524 of the turntable beyond what might otherwise be available.

Accordingly, if the robotic arm 504 were, for example, a 5-axis robot without the turntable 510, then a $6^{th}$ axis of movement is provided by the ability of the robotic arm 504 to manipulate the turntable 510. Similarly, as another example, a typical 6-axis robotic arm 504 would have a $7^{th}$ axis of movement through manipulation of the turntable 510.

The robotic arm 504 comprises a securing mechanism to selectively engage a product for manipulation or movement by the robotic arm. The securing mechanism may be a vacuum system or a gripping member. For example, in some embodiments, a vacuum may suction a bag to lift the bag off the product conveyer 502 and stop producing the suction to release the bag. In some embodiments, the securing mechanism may be a gripping member, such as a claw; the gripping member may apply a clamping force to the bag to seize and hold the bag until the gripping member releases the bag.

In some embodiments, the gripping member may be a basket that selectively encloses one or more bags and opens the bottom of the basket to release the bags. In some embodiments, the basket may be hinged across the middle of the top such that the basket opens along a seam around the center of the basket. The basket may swing closed around one or more bags on the product conveyer 502 or the product conveyer may propel the one or more bags into an open side of the basket when the basket is in a closed position. The robotic arm 504 may then position the one or more bags in the desired stacking spot and change the basket to an open position to release the one or more bags.

During the loading process the robotic arm 504 stacks the product on a platform to support a stack (e.g., a pallet 516, or a bin 506) based on the orientation of the platform. The platform may be supported by the turntable 510 that rotates the platform during the loading process. The turntable 510 may track its orientation and/or an orientation of the platform. The turntable 510 may be an additional axis (e.g., a $7^{th}$ axis) of the robotic arm 504, controllable by a controller or other logic of the robotic arm 504. In other embodiments, the turntable 510 may be an extension of the robotic arm 504. In still other embodiments, turntable 510 may be separate from and controlled by the robotic arm 504 and provide the orientation of the platform to the robotic arm 504.

The robotic arm 504 may stack bales 512 directly onto a pallet or may stack bags into a bin 506 on a pallet. In some embodiments, the bales may be transported into the product stacking subsystem 108 via a first conveyer, and the bags may be transported into the product stacking subsystem 108 via a second conveyer. In some embodiments, the robotic arm 504 may determine which conveyer to grab the bags or bales from based on a presence of a bin or a pallet on the turntable 510. In some embodiments, both conveyers may feed onto a single loading area and a switch may prevent the bags from entering the loading area when a pallet without a bin is on the turntable 510, and may prevent bales from entering the loading area when a pallet with a bin is on the turntable 510. The presence of a bin may be detected based on imaging, weight, and/or manual user input.

The pallet feeder 514 may provide pallets to the product stacking subsystem 108. The pallet feeder 514 may comprise a housing capable of receiving a plurality of pallets. The pallets may be stacked within the pallet feeder 514, and a pallet conveyer 518 may pull a pallet 516 through a slot in the housing. A user may choose to load the pallet with bales or to place a bin on the pallet 516 for loading.

The robotic arm 504 stacks either bales 512 or bags directly on a pallet 516 or in a bin 506. In some embodiments, the bin 506 may include a plurality of posts 508. The posts 508 may be in set locations, such as the corners of the bin 506. The shrink wrap dispenser 520 may apply shrink wrap around the exterior of the posts 508 to secure bags stacked above the bin 506.

When the robotic arm 504 is stacking bags into a bin 506, the robotic arm 504 may adjust its positioning based on a location of the posts and a height of the stacked bags. The robotic arm 504 may, based on an orientation of the turntable 510, determine the orientation of the bin 506. The robotic arm 504 may use the orientation of the bin 506 to determine a location of the posts 508 and move the product between the set of posts 508 while stacking the product until a height of the product stacked in the container reaches a threshold level. The threshold level may be based on a size (e.g., dimensions) of the robotic arm 504 and a size of the posts 508. In some embodiments, the threshold level may be a level at which the robotic arm 504 is capable of placing a bag over a post and onto the stack without dropping the bag (or without dropping the bag an undesired distance that may damage the product and/or bag). Once the threshold level is reached, the robotic arm 504 may stack the bags without considering the location of the posts 508.

The shrink wrap dispenser 520 may automatically apply shrink wrap around the plurality of posts 508 as the turntable rotates the bin 506 to extend the height of the bin 506. In some embodiments, the shrink wrap dispenser 520 may be part of or otherwise integrated with the turntable 510 and/or the robotic arm. In some embodiments, the shrink wrap dispenser 520 may begin to apply shrink wrap after a stacked product height reaches a target height in the bin. The target height may be such that the robotic arm 504 can position the product in the bin over top of the shrink wrap. In some embodiments, the target height may be the threshold level. The shrink wrap dispenser 520 may wrap the posts 508 for a specific number of turns and then cut the shrink wrap to stop applying the shrink wrap to the posts 508.

The height of the stacked product may be based on an elevation of the robotic arm 504 when stacking the product. For example, when the robotic arm 504 is releasing a bag onto the stack, that elevation may be recorded and used as the height of the product stack. In some embodiments, the height of the stacked product may be extrapolated from the weight of the bin. For example, if the weight and dimensions of each bag are known as well as the number of bags per level, the product stacking subsystem 108 may determine how many bags are in the bin and then determine how many levels of bags there are to determine the height of the stack.

After the pallet or bin is stacked to a desired height (e.g., a filled level), the pallet conveyer 518 may transport the bin/pallet to a shipping area 522. In the shipping area 522 a forklift may load the bins and pallets onto a truck for delivery.

Figure 6:
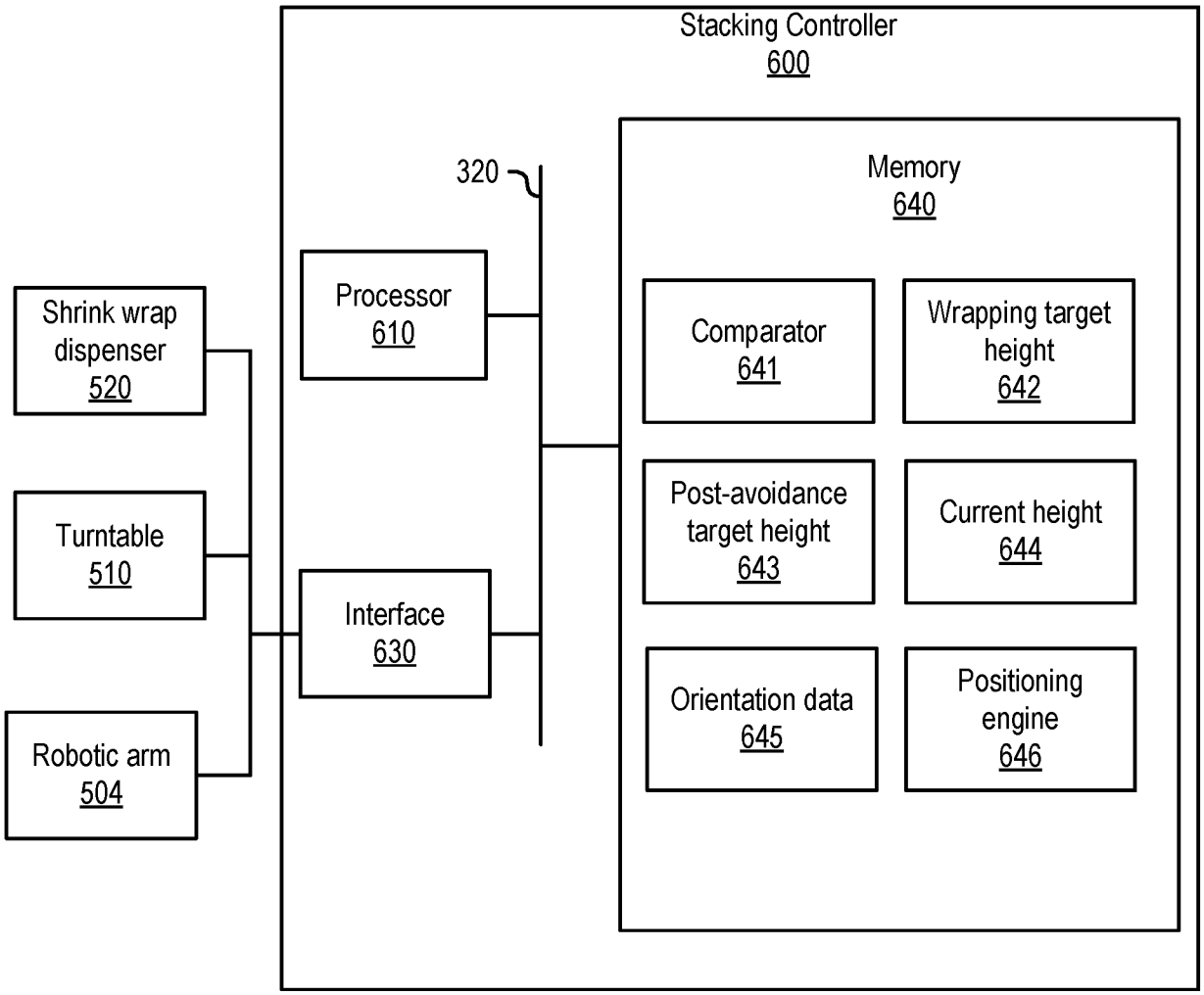
FIG. 6 is a block diagram of a stacking controller that may control the product stacking subsystem of FIG. 5.

FIG. 6 is a block diagram of a stacking controller 600 that may control the product stacking subsystem of FIG. 5. The stacking controller 600 may comprise a processor 610, a memory 640, and an interface 630. A bus 620 may interconnect various integrated and/or discrete components. The interface 630 may facilitate an interconnection between the stacking controller 600 and other devices such as the robotic arm 504, the turntable 510, and shrink wrap dispenser 520. These components may allow the stacking controller 600 to stack bags within a bin comprising a plurality of posts.

The processor 610 may include one or more general purpose devices, such as an Intel®, AMD®, or other standard microprocessor. The processor 610 may include a special purpose processing device, such as an ASIC, SoC, SiP, FPGA, PAL, PLA, FPLA, PLD, or other customized or programmable device. The processor 610 may perform distributed (e.g., parallel) processing to execute or otherwise implement functionalities of the presently disclosed embodiments.

The memory 640 may include static RAM, dynamic RAM, flash memory, one or more flip-flops, ROM, CD-ROM, DVD, disk, tape, or magnetic, optical, or other computer storage medium. The memory 640 may store a wrapping target height 642, post-avoidance target height 643, current height of the stack 644, orientation data of the bin 645, and programs to process the current height 644 and the orientation data of the bin 645 (e.g., comparator 641, positioning engine 646). The memory 640 may be local to the stacking controller 600, as shown, or may be distributed and/or remote relative to the stacking controller 600.

When the processor 610 executes the comparator 641 program, the stacking controller 600 compares the wrapping target height 642 and the post-avoidance target height 643 to the current height 644. If the current height 644 is above the post-avoidance target height 643, the processor 610 communicates with the robotic arm 504 to indicate that the robotic arm may safely stack the bags over the posts of the bin. If the current height 644 is below the post-avoidance target height 643, the processor 610 executes the positioning engine 646 to determine an approach of the robotic arm when loading the bin to avoid the posts. If the current height 644 is above the wrapping target height 643, the processor 610 communicates with the shrink wrap dispenser 520 to indicate that the shrink wrap dispenser 520 should apply shrink wrap around the posts as the turntable 510 rotates the bin.

The orientation data 645 may be received from the turntable 510. The orientation data 645 may indicate an orientation of the turntable 510. When the processor 610 executes the positioning engine 646, the processor 610 may use the orientation data 645 to determine a position of the posts of the bins, and determine an approach angle for the robotic arm 504 to avoid the posts while loading the bags into the bin.

In the embodiment of FIG. 6, the robotic arm 504, turntable 510, and shrink wrap dispenser 520 are depicted as discrete components each directed by the stacking controller 600. As can be appreciated, in other embodiments the turntable 510 is integrated with or otherwise an extension of the robotic arm 504. For example, the turntable 510 may provide an additional axis (e.g. a $7^{th}$ axis of a 6-axis robot) of movement for the robotic arm 504. Similarly, in some embodiments, the shrink wrap dispenser 520 is integrated with or otherwise an extension of the robotic arm 504 and/or the turntable 510.

Figure 7:
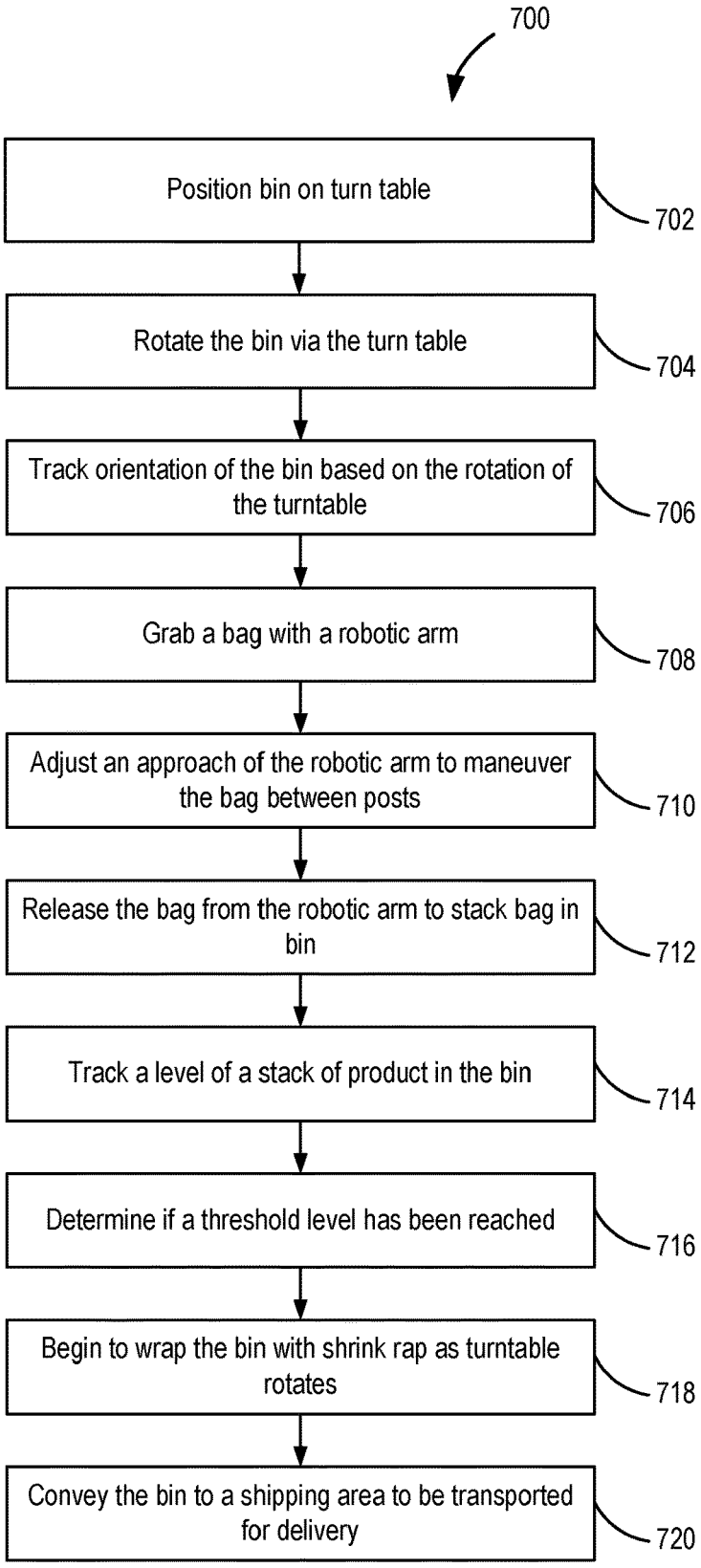
FIG. 7 is a flow diagram of a method of operating the product stacking subsystem of FIG. 5, according to some embodiments.

FIG. 7 is a flowchart illustrating a method 700 of a product stacking subsystem, according to some embodiments. The method includes positioning 702 a bin on a turntable. The bin may include a plurality of posts that extend above an opening of the bin. The bin may be placed on the turntable by loading the bin on a pallet that is on a conveyer, and the conveyer may push the pallet and bin onto the turntable. The turntable may rotate 704 the bin.

A controller may track 706 an orientation of the bin based on the rotation of the turntable. A robotic arm may grab 708 or otherwise grip a bag with a securing mechanism. The controller may adjust 710 an approach of the robotic arm as the robotic arm moves the bag toward the bin to maneuver the bag between the posts to place the bag in the bin. The robotic arm may release 712 the bag into the bin to stack the bag.

Figure 8:
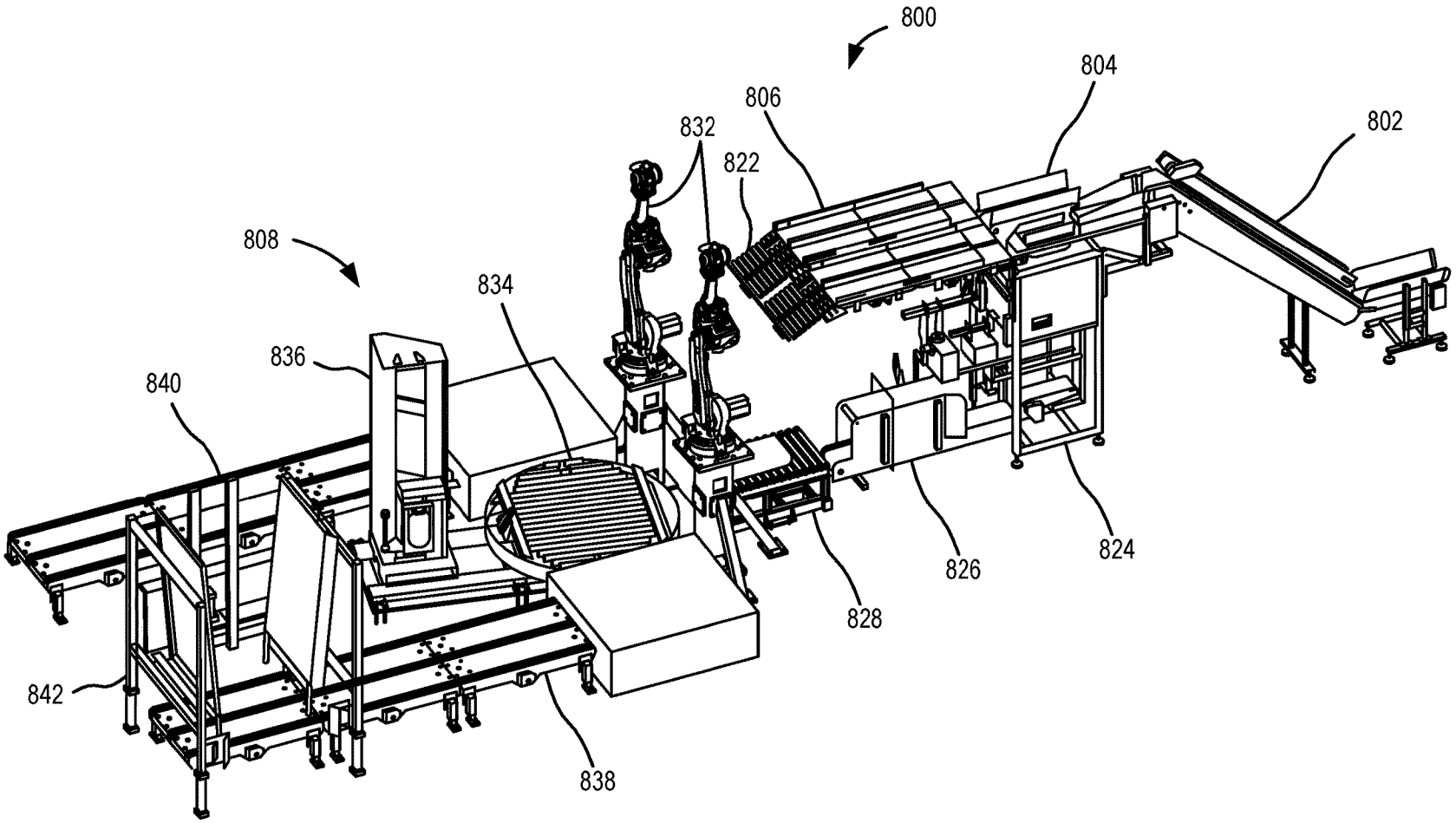
FIG. 8 is a perspective view of a product packaging system in accordance with another embodiment of the present disclosure.

The controller may also track 714 a level (e.g., height) of a stack of product (e.g., the stacked bags) in the bin and determine 716 whether a threshold level has been reached and/or whether a filled level has been reached. When the threshold level is reached, a shrink wrap dispenser may begin to wrap 718 the bin with shrink wrap by dispensing and applying shrink wrap to the bin as the turntable rotates the bin. Upon both the filled level being reached and the shrink wrap completing, the product stacking system may convey 720 the bin to a shipping area to be transported for delivery, FIG. 8 is a perspective view of a product packaging system 800 in accordance with another embodiment of the present disclosure. The product packaging system 800 includes an inlet conveyor 802, a diverter 804, a set of one or more buffer conveyor lanes 806, and a stacking subsystem 808. The product packaging system 800 may stack product on pallets or in containers for delivery and/or storage.

The inlet conveyor 802 receives packaged product, such as bags of produce. The inlet conveyor 802 may receive the packaged product directly from a bagger (e.g., bagger 102 of FIG. 1), from a loading mechanism, or any other appropriate manner of providing packaged product to the packaging system 800 for stacking. The inlet conveyor 802 transports the packaged product to the diverter 804, which directs the packaged product to a given buffer conveyor lane in the set of buffer conveyor lanes 806. The diverter 804 may direct the packaged product to one buffer conveyor lane of the set of buffer conveyor lanes 806 according to available space within the set of buffer conveyor lanes 806. The set of buffer conveyor lanes 806 present the packaged product at a bag pick point 822 for the stacking subsystem 808.

In the illustrated embodiment, the diverter 804 may also comprise a baler 824. The product packaging system 800 may selectively use the baler 824 to package multiple bags together. The baler 824 may count the number of bags that enter the baler and pack the bags into a bale once a desired number of bags is accumulated. The bales may comprise large bags to store the accumulated bags. Once the large bags are filled, the baler 824 may close and seal the large bags. A bale infeed 826 can then present a bale at a bale pick point 828.

In the illustrated embodiment of FIG. 8, the product stacking system 808 includes a set of robotic arms 832, a turntable 834, a wrap dispenser 836, a platform infeed 838, and a platform outfeed 840. The product stacking subsystem 808 stacks the bags or bales of packaged product. The product stacking subsystem 808 may stack the bags or bales directly on a pallet or in a container. In some embodiments, the product stacking subsystem 808 may determine whether the product is packaged in a bag or a bale and stack based on that determination. For example, the product stacking subsystem 808 may stack bales directly on a pallet and may stack bags into a container. The container may be an object capable of holding the bags during transport. For example, the container may be a bin, basket, box, or crate. In some embodiments, the container is a bin comprising a plurality of posts that may be used to extend the height of the bin.

The product stacking subsystem 808 of FIG. 8 includes a pair of robotic arms to engage, move, and release product (e.g., a bag, a bale, etc.) to stack the product on a pallet or in a container. The set of robotic arms 832 can include one or more multi-axis robotic arms to pick packaged product from one or both of the bag pick point 822 and the bale pick point 828. Each robotic arm 832 may be an appropriate robotic mechanism to access packaged product provided to the product stacking subsystem 808, engage the packaged product, move the packaged product, and place the packaged product onto a stack (e.g., on a pallet or in a container), and release the packaged product. In the illustrated embodiment, the set of robotic arms 832 comprise a pair of 6-axis robots. Each 6-axis robot 832 can position an object in three axes of space (Cartesian coordinates x, y, z) and orient the object in three axes of orientation (yaw, pitch and roll). As can be appreciated, a robotic arm 832 may comprise fewer axes of movement.

In some embodiments, a robotic arm 832 may include the turntable 834, which thereby provides the robotic arm 832 an additional axis of movement. Stated differently, the turntable 834 may be a part of or otherwise controlled by a controller of the set of robotic arms 832, such each robotic arm 832 includes an additional axis of movement beyond what might otherwise be available. Accordingly, if the robotic arm 832 were, for example, a 5-axis robot without the turntable 834, then a $6^{th}$ axis of movement is provided by the ability of the robotic arm 832 to manipulate the turntable 834. Similarly, as another example, a typical 6-axis robotic arm 832 would have a $7^{th}$ axis of movement through manipulation of the turntable 834.

Each robotic arm 832 comprises a securing mechanism to selectively engage a product for manipulation or movement by the robotic arm. The securing mechanism may be a vacuum system or a gripping member. For example, in some embodiments, a vacuum may suction a bag to lift the bag from the pick point 822 or the bale pick point 828 and stop producing the suction to release the bag. In some embodiments, the securing mechanism may be a gripping member, such as a claw; the gripping member may apply a clamping force to the bag to seize and hold the bag until the gripping member releases the bag. In some embodiments, the gripping member may be a basket that selectively encloses one or more bags and opens the bottom of the basket to release the bags. The robotic arm 832 may then position the one or more bags in the desired stacking spot and change the basket to an open position to release the one or more bags.

During the loading (or stacking) process one of the set of robotic arms 832 stacks the product on a platform to support a stack (e.g., a pallet, or a bin) based on the orientation of the platform. The platform may be supported by the turntable 834 that rotates the platform during the loading process. The turntable 834 may track its orientation and/or an orientation of the platform. The turntable 834 may be an additional axis (e.g., a $7^{th}$ axis) of the robotic arm 832, controllable by a controller or other logic of the robotic arm 832. In other embodiments, the turntable 834 may be an extension of the robotic arm 832. In still other embodiments, turntable 834 may be separate from and controlled by the robotic arm 832 and provide the orientation of the platform to the robotic arm 832.

The platform infeed 838 may provide platforms (e.g., pallets and/or bins) to the product stacking subsystem 808. In the illustrated embodiment of FIG. 8, the platform infeed 838 is a pallet infeed 838 and includes a pallet dispenser 842 with a housing capable of receiving a plurality of pallets. The pallets may be stacked within the pallet dispenser 842, and the platform infeed 838 may pull a pallet through a slot in a housing of the dispenser 842.

The set of robotic arms 832 stacks either bales or bags directly on a pallet or in a bin. As described above with reference to FIG. 5, In some embodiments, the bin may include a plurality of posts. The posts may be in set locations, such as the corners of the bin. The wrap dispenser 836 may apply a wrap (e.g., shrink wrap) around the exterior of the posts to secure bags stacked above an upper rim of the bin.

When each robotic arm 832 is stacking bags into a bin, the robotic arm 832 may adjust its positioning based on a location of the posts and a height of the stacked bags. The robotic arm 832 may, based on an orientation of the turntable 834, determine the orientation of the bin. The robotic arm 832 may use the orientation of the bin to determine a location of the posts and move the product between the set of posts while stacking the product until a height of the product stacked in the container reaches a threshold level. The threshold level may be based on a size (e.g., dimensions) of the robotic arm 832 and a size of the posts. In some embodiments, the threshold level may be a level at which the robotic arms 832 is capable of placing a bag over a post and onto the stack without dropping the bag (or without dropping the bag an undesired distance that may damage the product and/or bag). Once the threshold level is reached, the robotic arms 832 may stack the bags without considering the location of the posts.

The wrap dispenser 836 may automatically apply shrink wrap around the plurality of posts as the turntable rotates the bin. The shrink warp is applied to raise or otherwise extend the height of the bin. In some embodiments, the wrap dispenser 836 may be part of or otherwise integrated with the turntable 834 and/or the set of robotic arms 832. In some embodiments, the shrink wrap dispenser 836 may begin to apply shrink wrap after a stacked product height reaches a target height in the bin. The target height may be such that the robotic arm 832 can position the product in the bin over a top edge of the shrink wrap. In some embodiments, the target height may be the threshold level. The wrap dispenser 836 may wrap the posts for a specific number of turns and then cut the shrink wrap to stop applying the shrink wrap to the posts.

The height of the stacked product may be based on an elevation of the robotic arm 832 when stacking the product. For example, when the robotic arm 832 is releasing a bag onto the stack, that elevation may be recorded and used as the height of the product stack. In some embodiments, the height of the stacked product may be extrapolated from the weight of the bin. For example, if the weight and dimensions of each bag are known as well as the number of bags per level, the product stacking subsystem 808 may determine how many bags are in the bin and then determine how many levels of bags there are to determine the height of the stack.

After the pallet or bin is stacked to a desired height (e.g., a filled level), the platform outfeed 840 may transport the bin/pallet to a transport area or a storage area. In the transport area a forklift may load the bins and pallets onto a truck for delivery.

The foregoing specification has been described with reference to various embodiments, including the best mode. However, those skilled in the art appreciate that various modifications and changes can be made without departing from the scope of the present disclosure and the underlying principles of the invention. Accordingly, this disclosure is to be regarded in an illustrative rather than a restrictive sense, and all such modifications are intended to be included within the scope thereof. Likewise, benefits, other advantages, and solutions to problems have been described above with regard to various embodiments. However, benefits, advantages, solutions to problems, and any element(s) that may cause any benefit, advantage, or solution to occur or become more pronounced are not to be construed as a critical, required, or essential feature or element.

As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. Also, as used herein, the terms "coupled," "couple," and any other variation thereof are intended to cover a physical connection, an electrical connection, a magnetic connection, an optical connection, a communicative connection, a functional connection, and/or any other connection.

Principles of the present disclosure may be reflected in a computer program product on a tangible computer-readable storage medium having computer-readable program code means embodied in the storage medium. Any suitable computer-readable storage medium may be utilized, including magnetic storage devices (hard disks, floppy disks, and the like), optical storage devices (CD-ROMs, DVDs, Blu-Ray discs, and the like), flash memory, and/or the like. These computer program instructions may be loaded onto a general purpose computer, special purpose computer, or other programmable data processing apparatus to produce a machine, such that the instructions that execute on the computer or other programmable data processing apparatus create means for implementing the functions specified. These computer program instructions may also be stored in a computer-readable memory that can direct a computer or other programmable data processing apparatus to function in a particular manner, such that the instructions stored in the computer-readable memory produce an article of manufacture including instruction means which implement the function specified. The computer program instructions may also be loaded onto a computer or other programmable data processing apparatus to cause a series of operational steps to be performed on the computer or other programmable apparatus to produce a computer-implemented process such that the instructions which execute on the computer or other programmable apparatus provide steps for implementing the functions specified.

Principles of the present disclosure may be reflected in a computer program implemented as one or more software modules or components. As used herein, a software module or component (e.g., engine, system, subsystem) may include any type of computer instruction or computer-executable code located within a memory device and/or computer-readable storage medium. A software module may, for instance, comprise one or more physical or logical blocks of computer instructions, which may be organized as a routine, a program, an object, a component, a data structure, etc., that perform one or more tasks or implement particular data types.

In certain embodiments, a particular software module may comprise disparate instructions stored in different locations of a memory device, which together implement the described functionality of the module. Indeed, a module may comprise a single instruction or many instructions, and may be distributed over several different code segments, among different programs, and across several memory devices. Some embodiments may be practiced in a distributed computing environment where tasks are performed by a remote processing device linked through a communications network. In a distributed computing environment, software modules may be located in local and/or remote memory storage devices. In addition, data being tied or rendered together in a database record may be resident in the same memory device, or across several memory devices, and may be linked together in fields of a record in a database across a network.

Suitable software to assist in implementing the invention is readily provided by those of skill in the pertinent art(s) using the teachings presented here and programming languages and tools, such as Java, Pascal, C++, C, database languages, APIs, SDKs, assembly, firmware, microcode, and/or other languages and tools.

Embodiments as disclosed herein may be computer-implemented in whole or in part on a digital computer. The digital computer includes a processor performing the required computations. The computer further includes a memory in electronic communication with the processor to store a computer operating system. The computer operating systems may include, but are not limited to, MS-DOS, Windows, Linux, Unix, AIX, CLIX, QNX, OS/2, and Apple. Alternatively, it is expected that future embodiments will be adapted to execute on other future operating systems.

In some cases, well-known features, structures or operations are not shown or described in detail. Furthermore, the described features, structures, or operations may be combined in any suitable manner in one or more embodiments. It will also be readily understood that the components of the embodiments as generally described and illustrated in the figures herein could be arranged and designed in a wide variety of different configurations.

While the principles of this disclosure have been shown in various embodiments, many modifications of structure, arrangements, proportions, the elements, materials and components, used in practice, which are particularly adapted for a specific environment and operating requirements, may be used without departing from the principles and scope of this disclosure. These and other changes or modifications are intended to be included within the scope of the present disclosure.

The scope of the present invention should, therefore, be determined only by the following claims.

The invention claimed is:

1. A product stacking system, comprising:

a turntable to support a bin comprising a plurality of posts that extend above an opening of the bin, the turntable to:

rotate the bin during a loading process during which a robotic arm stacks a product within the bin, track an orientation of the bin as rotation of the bin occurs, and provide the orientation of the bin to the robotic arm; and a wrap dispenser to automatically apply a wrap around the plurality of posts as the turntable rotates the bin.

2. The product stacking system of claim 1, further comprising a robotic arm comprising a securing mechanism to selectively engage a product for manipulation or movement by the robotic arm, wherein during the loading process the robotic arm positions itself based on the orientation of the bin while stacking the product in the bin.

3. The product stacking system of claim 2, wherein the robotic arm moves in reference to the bin using a plurality of axes, one of which is provided by rotation of the turntable.

4. The product stacking system of claim 2, wherein the robotic arm moves in reference to the bin using 7 axes, including rotation of the bin by the turntable.

5. The product stacking system of claim 2, wherein the turntable is integrated with the robotic arm.

6. The product stacking system of claim 2, wherein the robotic arm determines a position to move the product between the plurality of posts while stacking the product until a height of the product stacked in the bin reaches a threshold level.

7. The product stacking system of claim 1, wherein the wrap dispenser begins to apply the wrap after a stacked product height reaches a threshold level in the bin.

8. The product stacking system of claim 7, wherein the threshold level is such that the robotic arm can position the product in the bin over a top edge of the wrap.

9. The product stacking system of claim 7, wherein the stacked product height is based on an elevation of the robotic arm when stacking the product.

10. A product stacking system, comprising:

a robotic arm comprising a securing mechanism to selectively engage a product for manipulation or movement by the robotic arm; and a turntable to support a platform to support one or more stacks of the product, the turntable to rotate the platform during a loading process, wherein, during the loading process, the robotic arm stacks the product on the platform based on the orientation of the platform.

11. The product stacking system of claim 10, wherein the robotic arm moves in reference to the bin with a plurality of axes, one of which the rotation of the turntable.

12. The product stacking system of claim 11, wherein the robotic arm moves in reference to the bin with 7 axes, one of which is rotation of the bin by the turntable.

13. The product stacking system of claim 10, wherein the turntable is integrated with the robotic arm, the turntable to track an orientation of the platform and provide the orientation of the platform to the robotic arm.

14. The product stacking system of claim 10, wherein the turntable supports a container comprising a set of posts, and wherein a position of the robotic arm during the loading process is based on positions of the set of posts.

15. The product stacking system of claim 14, wherein the robotic arm determines the position to move the product between the set of posts while stacking the product until a height of the product stacked in the container reaches a threshold level.

16. A method for mechanically stacking a product, comprising:

positioning a bin on a turntable, wherein the bin comprises a plurality of posts that extend above an opening of the bin;

rotating the turntable to rotate the bin; and positioning a robotic arm to mechanically place a product in the bin based on the orientation of the bin and a location of posts of the bin.

17. The method of claim 16, further comprising applying shrink wrap around the plurality of posts as the turntable rotates the bin upon a level of product in the bin reaching a threshold level.

18. The method of claim 16, further comprising positioning the robotic arm between the plurality of posts while stacking the product until a height of the product stacked in the bin reaches a threshold level.

19. The method of claim 16, further comprising:

agitating a bag containing the product;

weighing the bag after being agitated;

comparing a weight of the bag to a target threshold; and directing the bag to one of a reject area and a shipping area based on the comparison.

* * * * *